US006477989B2

(12) United States Patent
Suzuki et al.

(10) Patent No.: US 6,477,989 B2
(45) Date of Patent: Nov. 12, 2002

(54) COOLING DEVICE FOR LIQUID-COOLED TYPE INTERNAL COMBUSTION ENGINE

(75) Inventors: Kazutaka Suzuki, Kariya (JP); Eizo Takahashi, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/777,567

(22) Filed: Feb. 6, 2001

(65) Prior Publication Data

US 2001/0020452 A1 Sep. 13, 2001

(30) Foreign Application Priority Data

Feb. 10, 2000 (JP) ..... 2000-038218

(51) Int. Cl.[7] ..... F01P 7/14
(52) U.S. Cl. ..... 123/41.1; 123/41.44
(58) Field of Search ..... 123/41.1, 41.44

(56) References Cited

U.S. PATENT DOCUMENTS 5,390,632 A 2/1995 Ikebe et al.

FOREIGN PATENT DOCUMENTS

| | | |
|---|---|---|
| JP | A-5-231148 | 9/1993 |
| JP | B2-2561218 | 9/1996 |
| JP | A-2000-45773 | 2/2000 |
| JP | A-2000-45774 | 2/2000 |

*Primary Examiner*—Noah P. Kamen
(74) *Attorney, Agent, or Firm*—Harness, Dickey & Pierce, PLC

(57) ABSTRACT

In a cooling device for an engine, having a motor-driven pump and a flow rate control valve, to obtain a predetermined discharge flow rate (circulating coolant amount) from the pump 500, a pump duty is minimized while maintaining a water flow resistance as low as possible (maintaining a valve opening degree θ as large as possible). Thereby, a value of an electric current flowing through the pump 500 becomes smaller to decrease the energy consumption (power consumption).

4 Claims, 11 Drawing Sheets

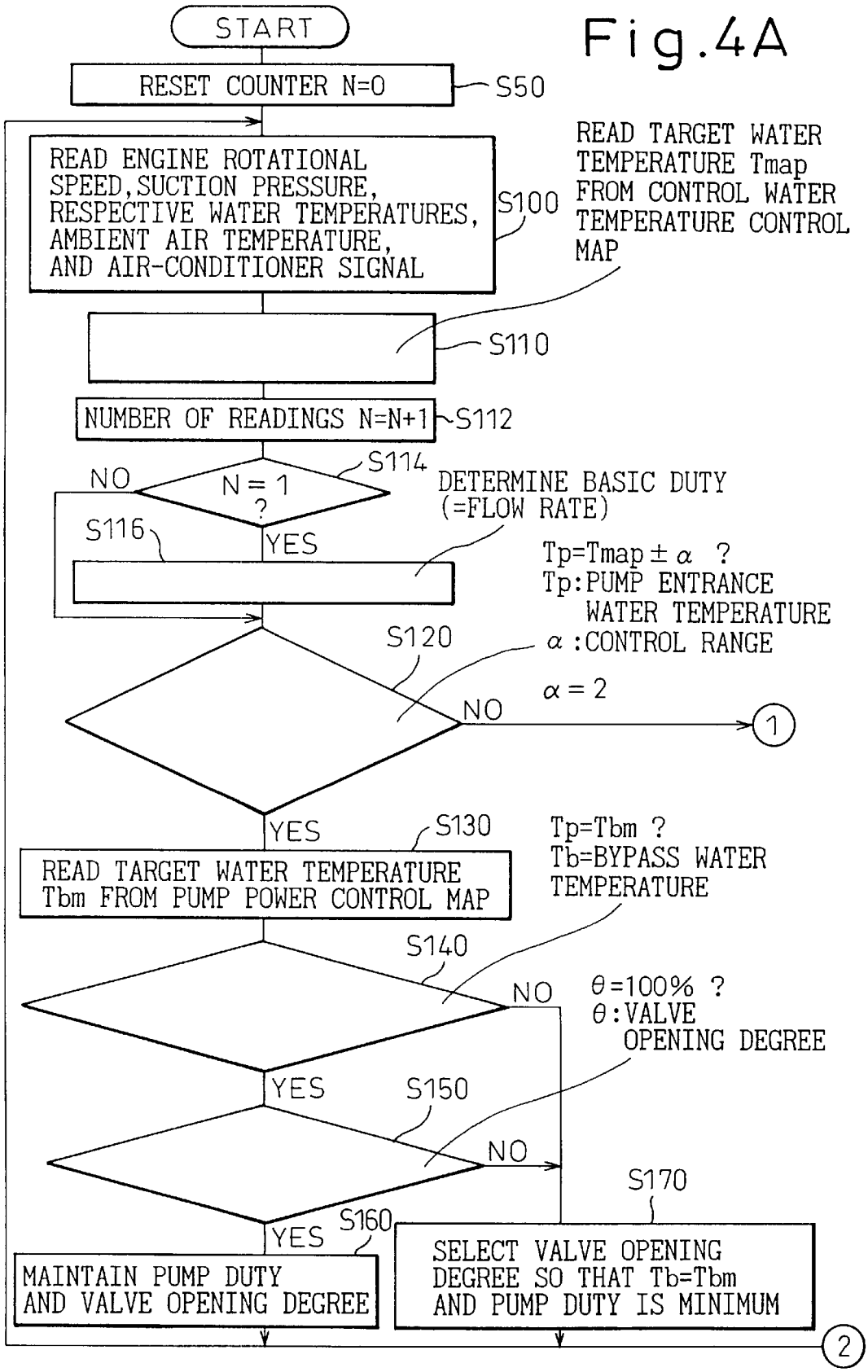
Fig.4A
START
RESET COUNTER N=0
S50
READ ENGINE ROTATIONAL SPEED, SUCTION PRESSURE, RESPECTIVE WATER TEMPERATURES, AMBIENT AIR TEMPERATURE, AND AIR-CONDITIONER SIGNAL
S100
READ TARGET WATER TEMPERATURE Tmap FROM CONTROL WATER TEMPERATURE CONTROL MAP
S110
NUMBER OF READINGS N=N+1
S112
S114
N = 1 ?
NO
YES
S116
DETERMINE BASIC DUTY (=FLOW RATE)
Tp=Tmap ± α ?
Tp: PUMP ENTRANCE WATER TEMPERATURE
α : CONTROL RANGE
α = 2
S120
NO
1
YES
S130
READ TARGET WATER TEMPERATURE Tbm FROM PUMP POWER CONTROL MAP
Tp=Tbm ?
Tb=BYPASS WATER TEMPERATURE
S140
NO
θ=100% ?
θ: VALVE OPENING DEGREE
YES
S150
NO
S170
YES
S160
MAINTAIN PUMP DUTY AND VALVE OPENING DEGREE
SELECT VALVE OPENING DEGREE SO THAT Tb=Tbm AND PUMP DUTY IS MINIMUM
2

Fig.5

| AIR-CONDITIONER LOAD $Le_1$, AMBIENT AIR TEMPERATURE $Ta_1$, AIR-CONDITIONER ON | | | | | | | | | | |
|---|---|---|---|---|---|---|---|---|---|---|
| PUMP DUTY | VALVE OPENING DEGREE | | | | | | | | | |
| | 10% | 20% | 30% | 40% | 50% | 60% | 70% | 80% | 90% | 100% |
| 10% | $Tbm_{01}$ | $Tbm_{02}$ | $Tbm_{03}$ | $Tbm_{04}$ | $Tbm_{05}$ | $Tbm_{06}$ | $Tbm_{07}$ | $Tbm_{08}$ | $Tbm_{09}$ | $Tbm_{10}$ |
| 20% | $Tbm_{11}$ | $Tbm_{12}$ | $Tbm_{13}$ | $Tbm_{14}$ | $Tbm_{15}$ | $Tbm_{16}$ | $Tbm_{17}$ | $Tbm_{18}$ | $Tbm_{19}$ | $Tbm_{20}$ |
| 30% | $Tbm_{21}$ | $Tbm_{22}$ | $Tbm_{23}$ | $Tbm_{24}$ | $Tbm_{25}$ | $Tbm_{26}$ | $Tbm_{27}$ | $Tbm_{28}$ | $Tbm_{29}$ | $Tbm_{30}$ |
| 40% | $Tbm_{31}$ | $Tbm_{32}$ | $Tbm_{33}$ | $Tbm_{34}$ | $Tbm_{35}$ | $Tbm_{36}$ | $Tbm_{37}$ | $Tbm_{38}$ | $Tbm_{39}$ | $Tbm_{40}$ |
| 50% | $Tbm_{41}$ | $Tbm_{42}$ | $Tbm_{43}$ | $Tbm_{44}$ | $Tbm_{45}$ | $Tbm_{46}$ | $Tbm_{47}$ | $Tbm_{48}$ | $Tbm_{49}$ | $Tbm_{50}$ |
| 60% | $Tbm_{51}$ | $Tbm_{52}$ | $Tbm_{53}$ | $Tbm_{54}$ | $Tbm_{55}$ | $Tbm_{56}$ | $Tbm_{57}$ | $Tbm_{58}$ | $Tbm_{59}$ | $Tbm_{60}$ |
| 70% | $Tbm_{61}$ | $Tbm_{62}$ | $Tbm_{63}$ | $Tbm_{64}$ | $Tbm_{65}$ | $Tbm_{66}$ | $Tbm_{67}$ | $Tbm_{68}$ | $Tbm_{69}$ | $Tbm_{70}$ |
| 80% | $Tbm_{71}$ | $Tbm_{72}$ | $Tbm_{73}$ | $Tbm_{74}$ | $Tbm_{75}$ | $Tbm_{76}$ | $Tbm_{77}$ | $Tbm_{78}$ | $Tbm_{79}$ | $Tbm_{80}$ |
| 90% | $Tbm_{81}$ | $Tbm_{82}$ | $Tbm_{83}$ | $Tbm_{84}$ | $Tbm_{85}$ | $Tbm_{86}$ | $Tbm_{87}$ | $Tbm_{88}$ | $Tbm_{89}$ | $Tbm_{90}$ |
| 100% | $Tbm_{91}$ | $Tbm_{92}$ | $Tbm_{93}$ | $Tbm_{94}$ | $Tbm_{95}$ | $Tbm_{96}$ | $Tbm_{97}$ | $Tbm_{98}$ | $Tbm_{99}$ | $Tbm_{100}$ |

$R_E$:ENGINE RESISTANCE
$R_R$:RADIATOR RESISTANCE
$R_V$:VALVE RESISTANCE (RADIATOR SIDE)
$R_B$:BYPASS + VALVE RESISTANCE (BYPASS SIDE)
$V_T$:TOTAL FLOW RATE ($=V_E$)
$V_R$:RADIATOR FLOW RATE
$V_B$:BYPASS FLOW RATE

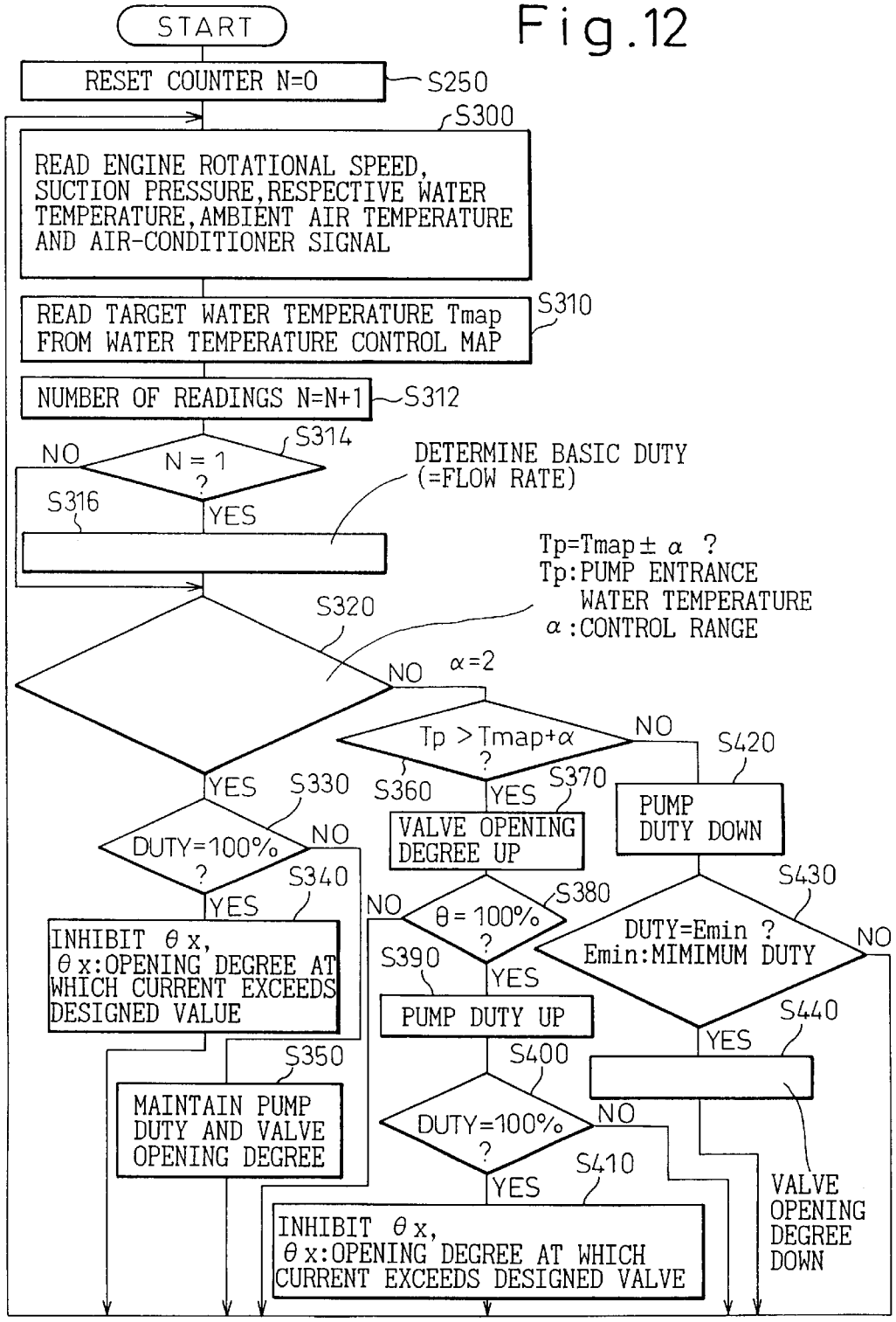
Fig.12
START
RESET COUNTER N=0
S250
S300
READ ENGINE ROTATIONAL SPEED, SUCTION PRESSURE, RESPECTIVE WATER TEMPERATURE, AMBIENT AIR TEMPERATURE AND AIR-CONDITIONER SIGNAL
READ TARGET WATER TEMPERATURE Tmap FROM WATER TEMPERATURE CONTROL MAP
S310
NUMBER OF READINGS N=N+1
S312
S314
N = 1 ?
NO
YES
S316
DETERMINE BASIC DUTY (=FLOW RATE)
Tp=Tmap± α ?
Tp:PUMP ENTRANCE WATER TEMPERATURE
α :CONTROL RANGE
S320
NO
α=2
Tp > Tmap+α ?
NO
S420
YES
S330
S360
YES
S370
PUMP DUTY DOWN
DUTY=100% ?
NO
VALVE OPENING DEGREE UP
S340
YES
S430
NO
θ = 100% ?
S380
DUTY=Emin ?
Emin:MIMIMUM DUTY
NO
INHIBIT θx, θx:OPENING DEGREE AT WHICH CURRENT EXCEEDS DESIGNED VALUE
S390
YES
PUMP DUTY UP
S440
YES
S350
S400
MAINTAIN PUMP DUTY AND VALVE OPENING DEGREE
DUTY=100% ?
NO
S410
YES
VALVE OPENING DEGREE DOWN
INHIBIT θx, θx:OPENING DEGREE AT WHICH CURRENT EXCEEDS DESIGNED VALVE

COOLING DEVICE FOR LIQUID-COOLED TYPE INTERNAL COMBUSTION ENGINE

BACKGROUND OF THE INVENTION

1. Field of the Invention

The present invention relates to a cooling device for a liquid-cooled type internal combustion engine, which is suitably applicable to a vehicle.

2. Description of the Related Art

In a conventional cooling device for a liquid-cooled type internal combustion engine, an electric (motor-driven) pump for circulating cooling water and an electric flow rate control valve for regulating a flow rate of cooling water circulating in a radiator are controlled independently from each other.

The conventional cooling device, however, is problematic from a point of view of decreasing the power (electric energy) consumption of the pump.

SUMMARY OF THE INVENTION

An object of the present invention is to decrease, in a cooling device for a liquid-cooled type internal combustion engine including an electric (motor-driven) pump and an electric flow rate control valve, the power (electric energy) consumption of the pump.

To achieve the above object, according to the present invention, a cooling device for a liquid-cooled type internal combustion engine is provided and comprises a radiator (200) for cooling coolant flowing out of an liquid-cooled type internal combustion engine (100) and returning the cooled coolant to the liquid-cooled type internal combustion engine (100), a bypass circuit (300) for making the coolant flowing out of the liquid-cooled type internal combustion engine (100) bypass the radiator (200) and return to the liquid-cooled type internal combustion engine (100), a motor-driven flow rate control valve (400) for regulating a bypass flow rate of coolant flowing through the bypass circuit (300) and a radiator flow rate of coolant flowing through the radiator (200), a motor-driven pump (500) for circulating the coolant through the liquid-cooled type internal combustion engine (100) and the radiator (200); the pump being driven independently from the liquid-cooled type internal combustion engine (100), and control means (600) for electrically regulating the motor-driven flow rate control valve (400) and the motor-driven pump (500) while associating the former with the latter.

Thereby, when a predetermined discharge flow rate from the motor-driven pump (500) must be obtained, it is possible to minimize the power consumption (electric energy consumption) of the motor-driven pump since the power consumption (electric energy consumption) of the pump (500) can be minimized while suppressing the water flow resistance as much as possible.

The present invention will be more fully understood from the following description of the preferred embodiments thereof with reference to the attached drawings.

BRIEF DESCRIPTION OF THE DRAWINGS

FIGS. 4A and 4B show a flow chart illustrating a method for controlling a cooling device according to a first embodiment of the present invention;

FIG. 5 is a numerical map for illustrating the relationship between a valve opening degree θ and a pump duty used for the cooling device according to the first embodiment of the present invention;

FIG. 12 is a flow chart illustrating a method for controlling a cooling device according to a second embodiment of the present invention;

BEST MODES FOR CARRYING OUT THE INVENTION (First Embodiment)

Figure 1:
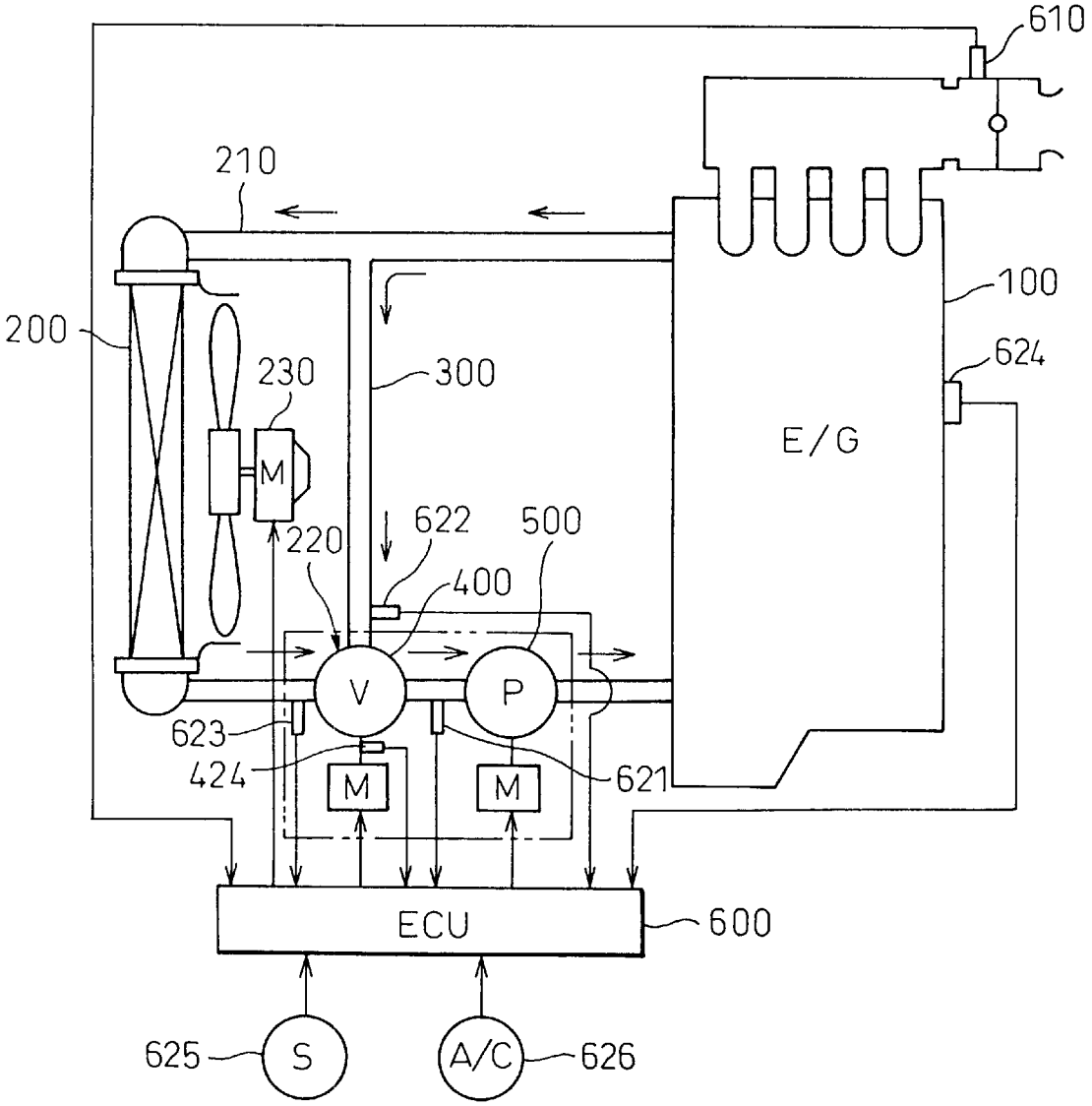
FIG. 1 is a schematic illustration of a cooling device according to one aspect of the present invention.

In this embodiment, a cooling device for a liquid-cooled type internal combustion engine according to the present invention is applied to a water-cooled type engine (a liquid-cooled type internal combustion engine) for a vehicle. FIG. 1 illustrates a schematic view of the cooling device of this embodiment.

In FIG. 1, reference numeral 200 denotes a radiator for cooling water (coolant) circulating the interior of a water-cooled type engine (hereinafter referred to as an engine) 199, and 210 denotes a radiator circuit for circulating the coolant through the radiator 200.

Reference numeral 300 denotes a bypass circuit for guiding the coolant flowing out of the engine 100 to a region of the radiator circuit 210 on an exit side of the radiator 200, while making the coolant bypass the radiator 200. At a position 220 at which the coolant from the bypass circuit 300 and that from the radiator circuit 210 meet, a rotary type electric flow rate control valve (hereinafter referred to as a control valve) 400 is provided for regulating a flow rate of the coolant passing through the radiator circuit 210 (hereinafter referred to as a radiator flow rate Vr) and a flow rate of the coolant passing through the bypass circuit 300 (hereinafter referred to as a bypass flow rate Vb). There is a motor-driven pump (hereinafter referred to as a pump) 500 operative independently from the engine 100 for circulating the coolant, downstream of the control valve 400 as seen in the flowing direction of the coolant (that is, at a position closer to the engine 100).

Now, a schematic structure of the control valve 400 will be described.

Figure 2B:
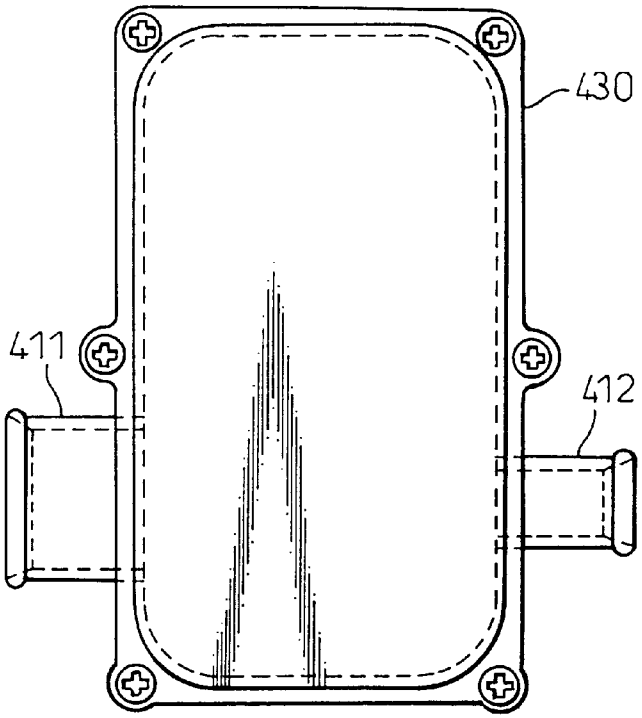
FIGS. 2A and 2B are a side view and a front view, respectively, of an assembly of a control valve and a pump according to one embodiment of the present invention.
Figure 2A:
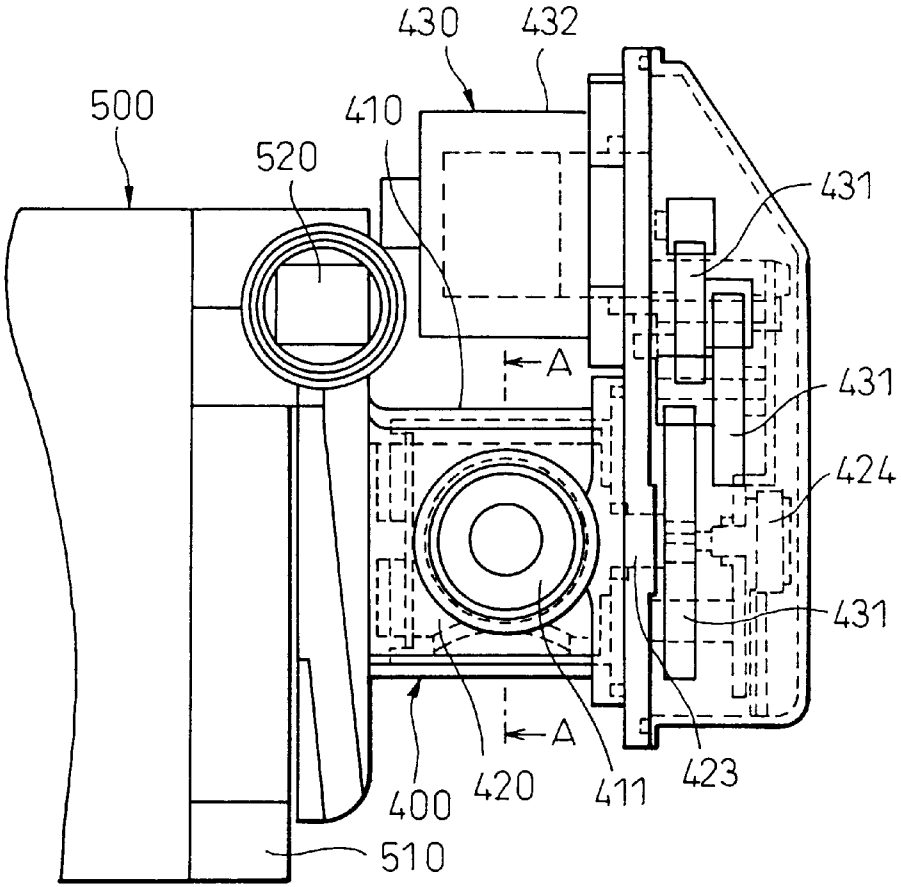

As shown in FIGS. 2A and 2B, the control valve 400 and the pump 500 are combined together by a pump housing 510 and a valve housing 410 to form a single unit. In this regard, both the housings 410 and 510 are made of resin.

Figure 3A:
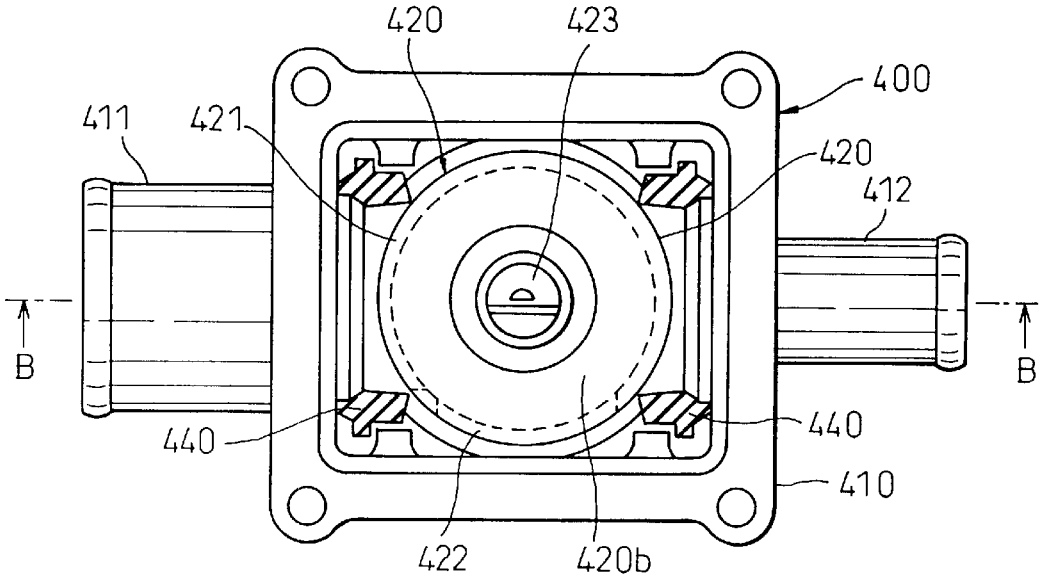
FIG. 3A is a sectional view taken along a line A—A in FIG. 2A.
Figure 3B:
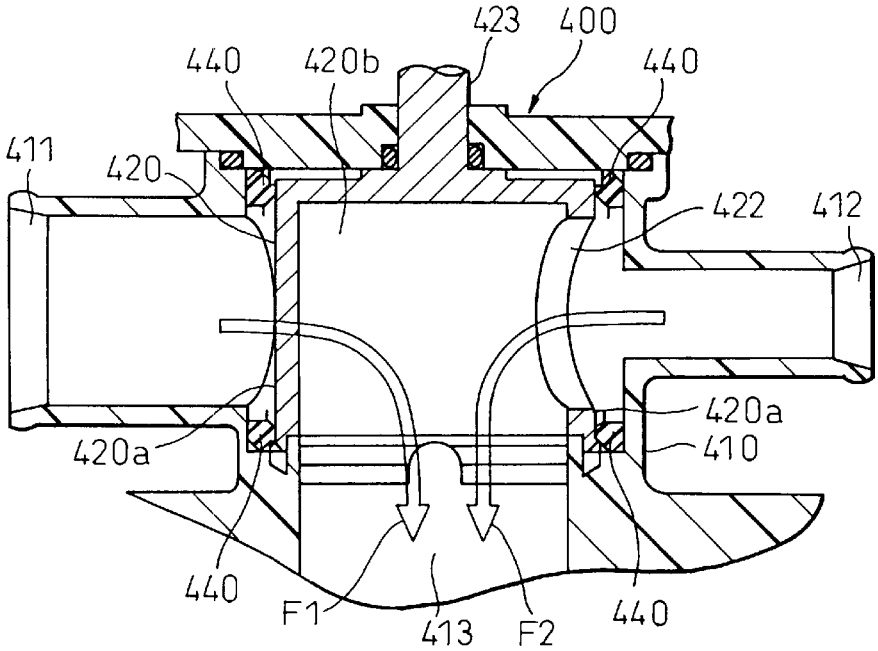
FIG. 3B is a sectional view taken along a line B—B in FIG. 3A.

As shown in FIGS. 3A and 3B, within the interior of the valve housing 410 is accommodated, in a rotatable manner, a cylindrical (cup-shaped) rotary valve (hereinafter referred to as a valve) 420, one longitudinal (axial) end of which is closed. The valve 420 is driven to rotate about the axis thereof by means of an actuator section 430 including a reduction gear unit consisting of a plurality of gears 431 and a servomotor (drive means) 432 as shown in FIG. 2A.

As shown in FIGS. 3A and 3B, first and second valve ports 421, 422 having the same shape (in this embodiment, circles of the identical diameter) are formed in a cylindrical side wall 420*a* of the valve 420 at positioned apart at an angular distance of approximately 90 degrees from each other to communicate the interior and the exterior of the cylindrical side wall 420*a* with each other.

On the other hand, in a region of the valve housing 410 corresponding to the cylindrical side wall 420*a* of the valve 420 are formed a radiator port (a radiator side entrance) 411 for communicating with the radiator circuit 210 and a bypass port (a bypass side entrance) 412 for communicating with the bypass circuit 300, as shown in FIG. 3.

Further, in a region of the valve housing 410 corresponding to the other axial end of the valve 420 is formed a pump port (an exit) 413 for communicating a cylindrical interior 420*b* of the valve 420 with the suction side of the pump 500.

Reference numeral 440 denotes a packing for tightly sealing a gap between the cylindrical side wall 420*a* of the valve 420 and the inner wall of the valve housing 410 so that the coolant from the fully closed one of the radiator port 411 and the bypass port 412 is prevented from flowing through the cylindrical interior 420*b* of the valve 420 into the pump port 413.

As shown in FIG. 2, a potentiometer (means for detecting an opening degree) 424 is provided in a rotary shaft 423 of the valve 420 for detecting a rotational angle (an opening degree of the control valve 400), and a detection signal from the potentiometer 424 is input to ECU 600 described later.

Reference numeral 600 denotes an electronic control unit (ECU) for controlling the control valve 400 and the pump 500. The ECU 600 is supplied with signals from a pressure sensor (a pressure detecting means) 610 for detecting a suction negative pressure of the engine 100, first to third water temperature sensors (temperature detecting means) 621 to 623 for detecting the temperature of coolant, a rotational speed sensor (rotational speed detecting means) 624 for detecting the rotational speed of the engine 100 and an ambient air temperature sensor (ambient air temperature detecting means) 625 for detecting the ambient air temperature, and ON-OFF signals from a starting switch 626 of an air-conditioner for a vehicle (not shown), to regulate the control valve 400, the pump 500 and a blower 230 based on these signals.

In this regard, the first water temperature sensor 621 detects the temperature of coolant flowing into the pump 500 (the engine 100) on the pump port 413 side (hereinafter, this temperature is referred to as a pump entrance water temperature Tp); the second water temperature sensor 622 detects the temperature of coolant flowing through the bypass circuit 300 on the bypass port 412 side, that is, the temperature of coolant flowing out of the engine 100 (hereinafter, this temperature is referred to as a bypass water temperature Tb); and the third water temperature sensor 623 detects the temperature of coolant flowing out of the radiator 200 on the radiator port 411 side (hereinafter, this temperature is referred to as a radiator water temperature Tr).

Figure 4B:
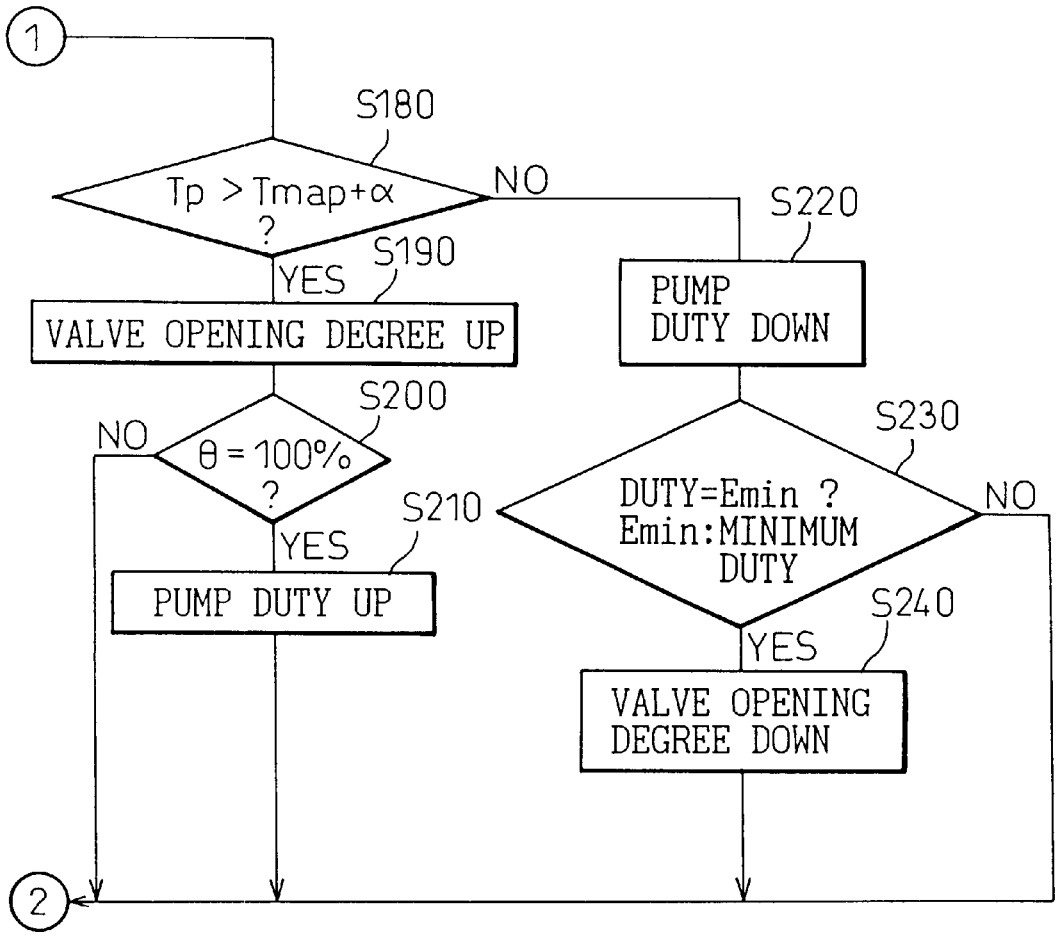

Next, the characteristic operation of this embodiment will be described with reference to a flow chart shown in FIGS. 4A and 4B.

When the engine 100 starts after an ignition switch (not shown) has been switched on, a counter is reset to zero (at S50). Then values detected by the rotational speed sensor 624, the pressure sensor 610, the first to third water temperature sensors 621 to 623, the ambient air temperature sensor 625 and the starting switch 626 are read (at S100).

An engine load is calculated by the rotational speed and the suction negative pressure of the engine 100, and a temperature of the coolant to be introduced into the engine 100 (hereinafter referred to as a first target water temperature Tmap) is determined based on the calculated engine load (at S110).

Then, the number of readings of various signals N=N+1 is calculated (at S112) to determine whether or not the number of the readings of the counter is 1 (at S114). If N=1, it is assumed that the engine 100 has now been started, and a voltage to be applied to the pump 500 and an opening degree of the control valve 400 are determined from a map not shown so that the first target water temperature Tmap is obtained, and the pump 500 and the control valve 400 are regulated to achieve the determined pump duty and valve opening degree θ (at S116).

In this case, the first target water temperature Tmap is determined so that the water temperature, when the engine load is large, is higher than that when the engine load is small.

In this regard, according to this embodiment, the application of voltage to the pump 500 is carried out by controlling the duty ratio of voltage applied to the pump (hereinafter, this is referred to as a pump duty), wherein the larger the pump duty, the larger the voltage to be applied to the pump 500, and vice versa.

In addition, the larger the opening degree of the control valve 400 (hereinafter, this is referred to as a valve opening degree), the larger the radiator flow rate Vr, and vice versa.

On the other hand, if it is determined that N≧2 at S114, then it is determined whether or not the pump entrance water temperature Tp is in a predetermined range defined by the first target water temperature Tmap (in this embodiment, this range is defined by Tmap±2° C.) (at S120). If the answer is affirmative, the second target water temperature Tbm is determined from the pump duty and the valve opening degree determined at S110 in accordance with a map shown in FIGS. 5 and 6 (at S130).

Figure 6:
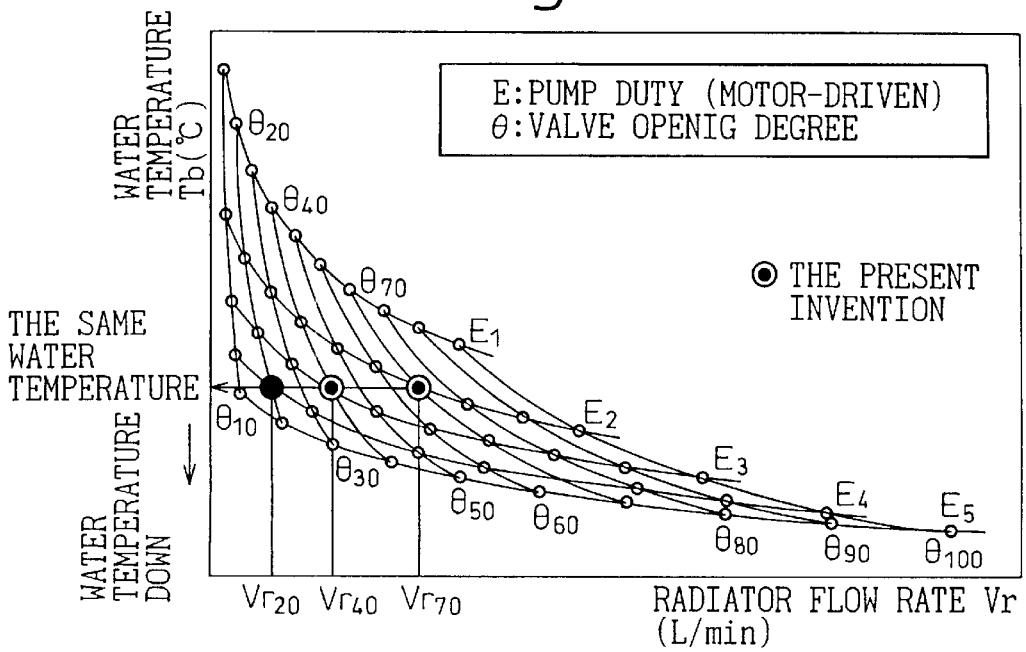
FIG. 6 is a graph illustrating the relationship between a valve opening degree θ and a pump duty used for the cooling device according to the first embodiment of the present invention.

In this regard, FIG. 6 is a graphic identical to the numerical map shown in FIG. 5, and numerical values shown in FIGS. 5 and 6 are variable in accordance with the engine load, the ambient air temperature and the state of the starting switch.

The bypass water temperature Tb is compared to the second target water temperature Tbm (at S140). If the bypass water temperature Tb is equal to the second target water temperature Tbm, it is determined whether or not the valve opening degree θ is 100% (at S150). If the answer is affirmative, the current valve opening degree θ and pump duty are maintained (at S160) and the routine returns to S100.

In this regard, if it is determined that the bypass water temperature Tb is different from the second target water temperature Tbm at S140, or if it is determined that the valve opening degree θ is smaller than 100% at S150, the valve opening degree θ is determined from the map shown in FIG.

6 so that the second target water temperature Tbm is equal to the bypass water temperature Tb as well as the pump duty becomes minimum, and the pump 500 and the control valve 400 are regulated to achieve the pump duty and the valve opening degree θ thus determined (at S170).

On the contrary, if the pump entrance water temperature Tp is out of the predetermined range defined by the first target water temperature Tmap, it is determined whether or not the pump entrance water temperature Tp is higher than the upper limit of the first target water temperature Tmap (at S180). If the answer is affirmative, the valve opening degree θ increases while maintaining the current pump duty as it is (at S190).

Next, it is determined whether or not the valve opening degree θ is 100% (at S200). If the answer is negative, the routine returns to S100. If the answer is affirmative, the routine returns to S100 after the pump duty has increased (at S210).

If it is determined that the pump entrance water temperature Tp is the upper limit of the first target water temperature Tmap or lower at S180, the pump duty is decreased to reduce an amount of circulating coolant so that a heat release amount in the radiator 200 (the radiator flow rate Vr) becomes smaller (at S220), and it is determined whether or not the pump duty thus decreased is the minimum value of the duty control range (in this embodiment, 10%) (at S230).

If the decreased pump duty is larger than the minimum value of the duty control range, the routine returns to S100. On the other hand, if the decreased pump duty is equal to the minimum value of the duty control range, the routine returns to S100 after the valve opening degree has reduced (at S240).

In this regard, the minimum value of the duty control range corresponds to a minimum voltage for movably controlling the pump 500.

Next, features of this embodiment will be described.

Figure 7:
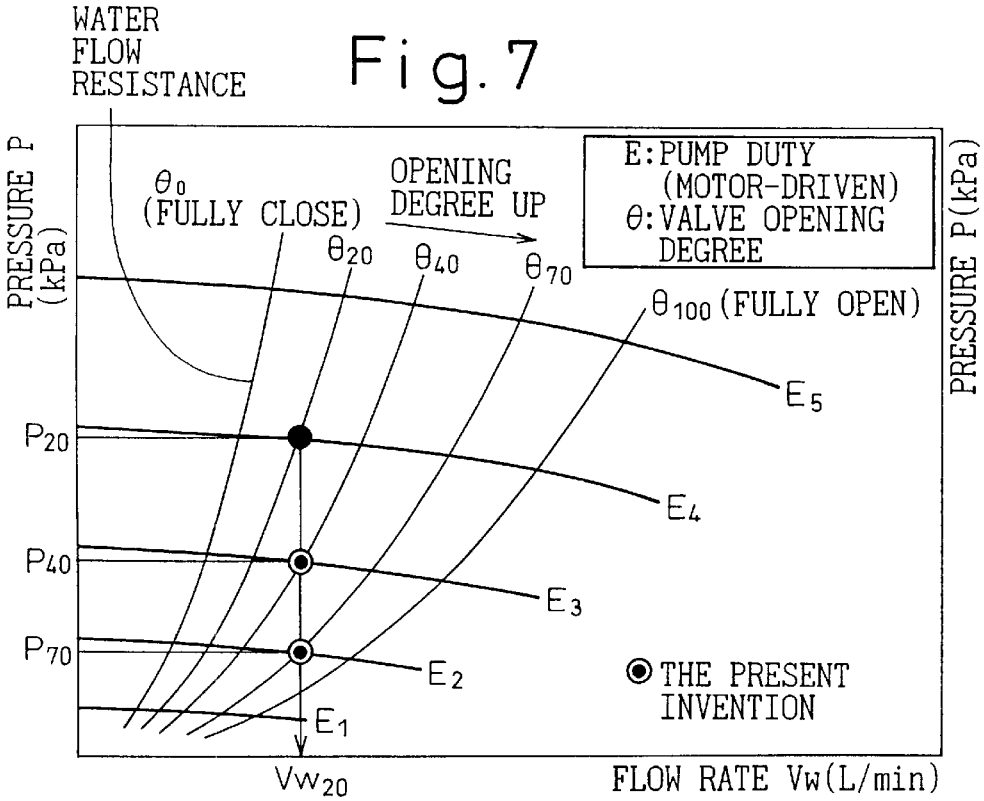
FIG. 7 is a characteristic graph illustrating the relationship between the valve opening degree θ and a pressure P.

FIG. 7 is a graph showing characteristic properties of the pump 500. As is apparent from this graph, even if the pump duty is constant, the discharge flow rate (an amount of circulating coolant) increases when the load of the pump 500 (pump work) becomes smaller, that is, when the water flow resistance becomes smaller by increasing the valve opening degree θ, because the discharge rate of the pump 500 (a circulating amount of coolant) increases.

Such a characteristic is not inherent to the pump 500 used in this embodiment, but common to all pumps of this type as described in the pump test results published as Japanese Industry Standard (JIS) B 8301.

Figure 8:
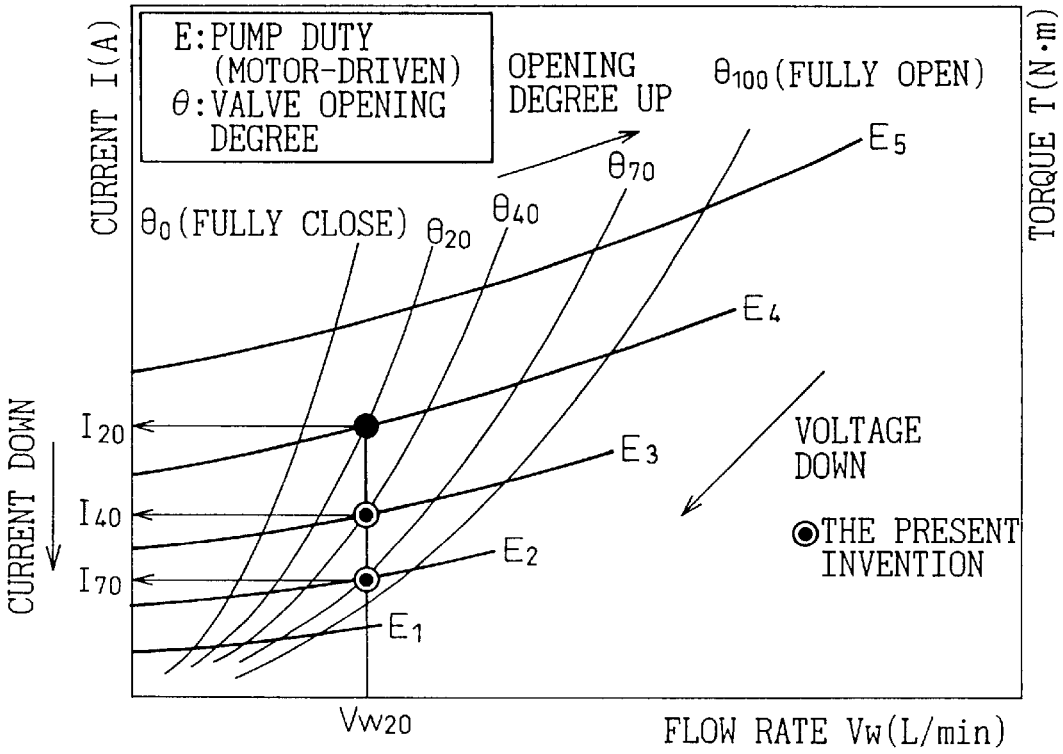
FIG. 8 is a characteristic graph illustrating the relationship between the valve opening degree θ and an electric current I.

Thereby, if the water flow resistance is made smaller (by increasing the valve opening degree θ) with the pump duty being maintained constant, the discharge pressure of the pump 500 (a torque of an electric motor for driving the pump 500) becomes smaller whereby the power to be supplied to the pump 500 (the electric current value flowing through the motor for driving the pump 500) decreases as shown in FIG. 8.

As is apparent from the above-mentioned description, when the predetermined discharge flow rate (amount of circulating coolant) of the pump 500 is obtained, it is possible to decrease the power consumption of the pump 500 if the pump duty is minimized under the condition in which the water flow resistance is as small as possible (the valve opening degree θ is as large as possible).

Therefore, according to this embodiment, as shown at S170, it is contemplated to reduce the power consumption of the pump 500 by regulating the opening degree of the flow rate control valve 400 based on the electric energy estimated to be consumed in the pump 500.

Accordingly, in this embodiment, as shown in S100 to S160, since the control of the control valve 40 and the pump 500 for reducing the power consumption is commenced while guaranteeing the radiator flow rate Vr sufficient for cooling the engine, it is possible to save the power consumption without deteriorating the cooling function as the engine cooling device.

Also, since the bypass flow rate is made to increase by decreasing the opening degree of the flow rate control valve 400 if the radiator flow rate Vr must be reduced, when the voltage applied to the pump 500 is minimum within the predetermined range as shown in S230 and S240, it is possible to regulate the radiator flow rate Vr while controlling the pump 500 in a stable manner.

(Second Embodiment)

According to the first embodiment, the power consumption of the pump 500 can be saved even if the same discharge flow rate is obtained, by increasing the valve opening degree θ to reduce the water flow resistance and thus lower the pump duty. It has, however, been found from the more detailed study that there is the following problem.

Figure 9:
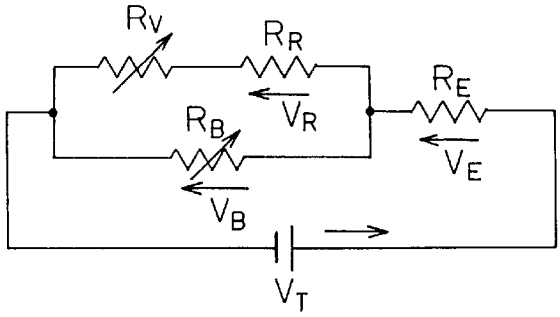
FIG. 9 illustrates an equivalent circuit of a water circulation system.

That is, FIG. 9 is an equivalent circuit showing a water flow resistance of a water flow system in the cooling device shown in FIG. 1. In some cases, a total water flow resistance may become minimum when the valve opening degree θ is smaller than 100% if the water flow resistances are so distributed in the respective parts. The valve opening degree θ at which the total water flow resistance becomes minimum is hereinafter referred to as a minimum resistance opening degree θx.

Figure 10A:
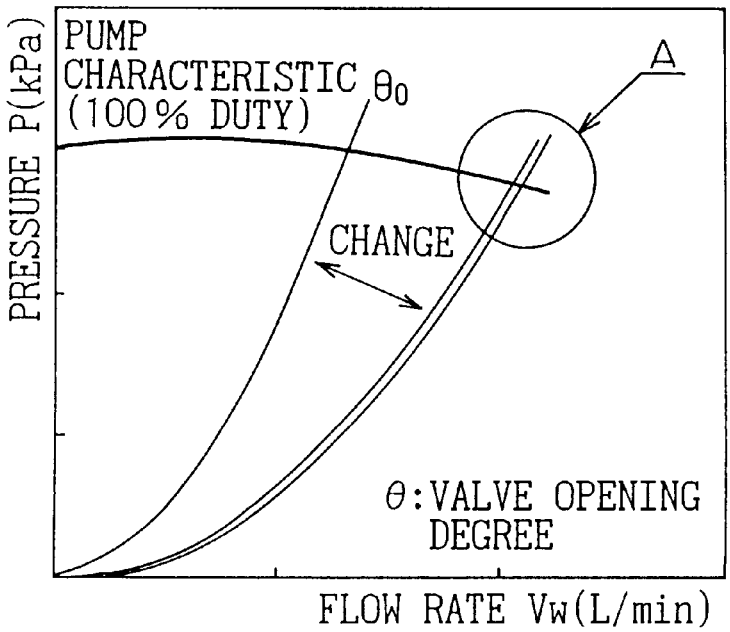
FIG. 10A is a graph illustrating the relationship between a valve opening degree θ and a discharge pressure.
Figure 10B:
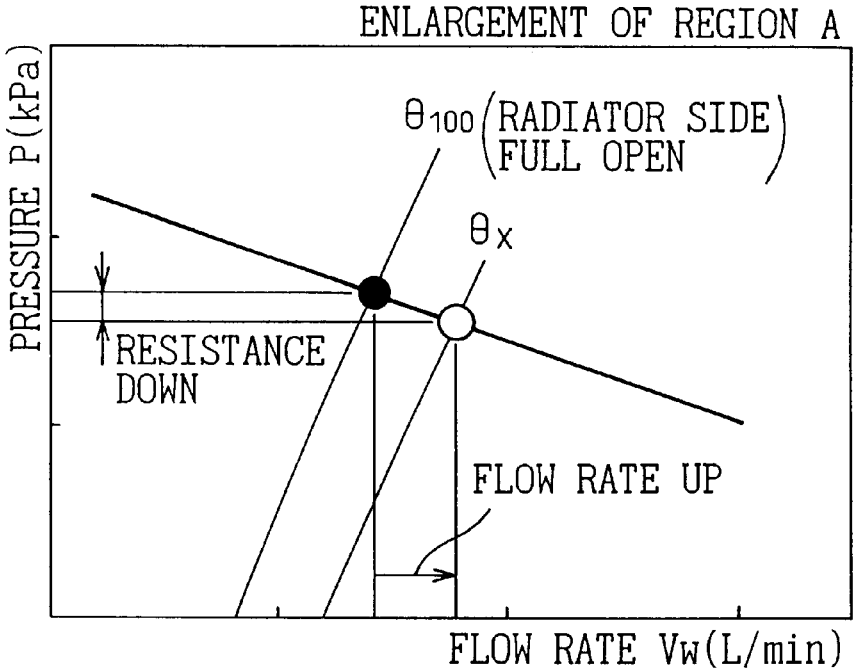
FIG. 10B is an enlarged view of an encircled region A in FIG. 10A.
Figure 11A:
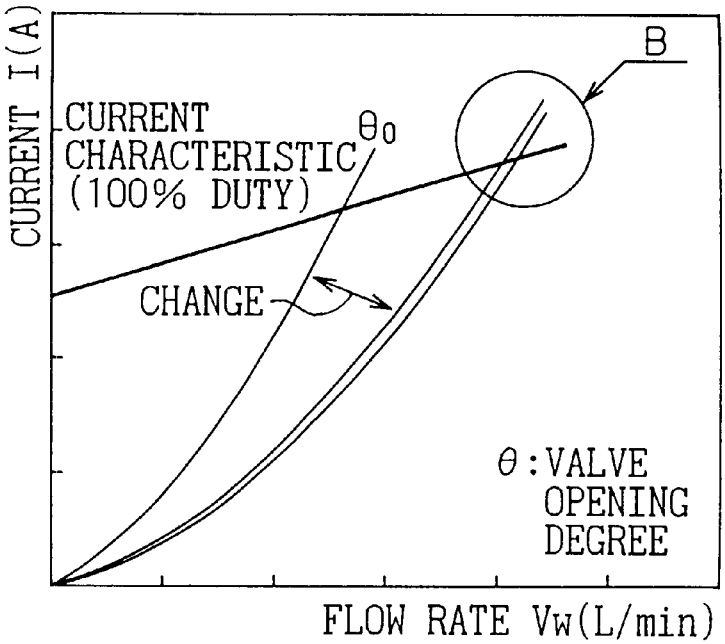
FIG. 11A is a graph illustrating the relationship between a flow rate and an electric current value.
Figure 11B:
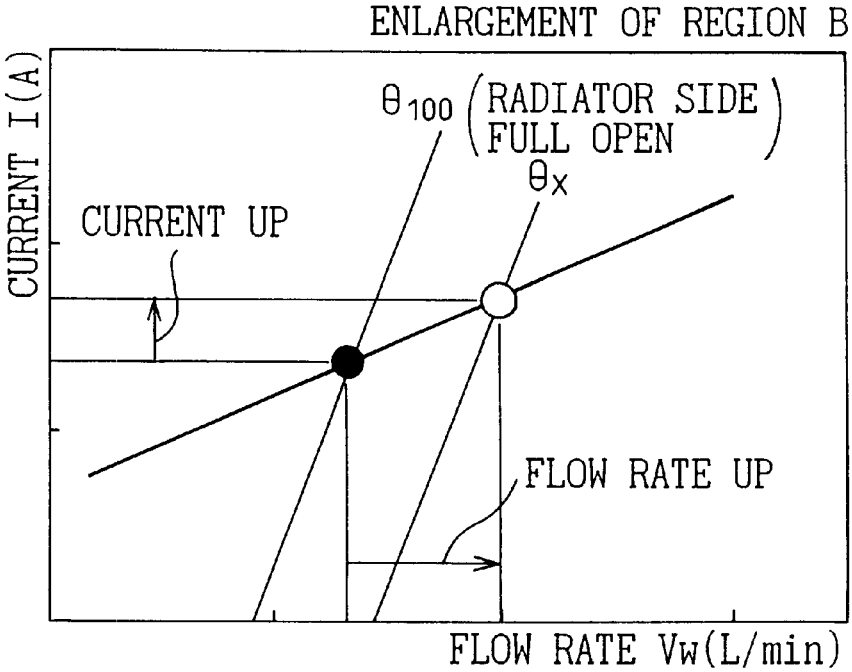
FIG. 11B is an enlarged view of an encircled region B in FIG. 11A.

If the valve opening degree θ becomes the minimum resistance opening degree θmin, for example, when the pump duty is 100%, the amount of circulating coolant increases more than that when valve opening degree θ is 100% as shown in FIGS. 10A and 10B. Therefore, there is a risk in that the electric energy to be supplied to the pump 500 (a current value flowing through the electric motor for driving the pump 500) may become larger than that when the pump duty is 100% to exceed the allowable current value supplied to the pump 500 (the motor therefor).

If such a state continues, in which the current larger than the allowable value flows, there is a risk damage to the pump 500 (including the control circuit for driving the motor). It is, of course, possible to solve this problem by using a pump 500 having a higher allowable current value. Such a solution, however, results in a rise in the production cost of the cooling device.

Thus, according to this embodiment, when the voltage applied to the pump 500 (pump duty) is the maximum value (100%) within a predetermined range, the pump 500 and the control valve 400 are regulated so that the valve opening degree θ does not reach the minimum resistance opening degree, which prevents the pump 500 (including the control circuit for driving the motor) from being broken.

Details of this embodiment will be described below with reference to a flow chart shown in FIG. 12:

When the engine 100 starts after an ignition switch (not shown) has been switched on, a counter is reset to zero (at S250). Then values detected by the rotational speed sensor 624, the pressure sensor 610, the first to third water temperature sensors 621 to 623, the ambient air temperature sensor 625 and the starting switch 626 are read (at S300).

An engine load is calculated by the rotational speed and the suction negative pressure of the engine 100, and a temperature of the coolant to be introduced into the engine 100 (hereinafter referred to as a first target water temperature Tmap) is determined based on the calculated engine load (at S310).

Then, the number of readings of various input signals N=N+1 is calculated (at S312) to determine whether or not the number of the readings of the counter is 1 (at S314). If N=1, it is assumed that the engine 100 has been started, and a voltage to be applied to the pump 500 and an opening degree of the control valve 400 are determined from a map not shown so that the first target water temperature Tmap is obtained, and the pump 500 and the control valve 400 are regulated to achieve the determined pump duty and valve opening degree θ (at S316).

On the other hand, if it is determined that N≧2 at S314, then it is determined whether or not the pump entrance water temperature Tp is in a predetermined range defined by the first target water temperature Tmap (in this embodiment, this range is defined by Tmap±2° C.) (at S320). If the answer is affirmative, the it is determined whether or not the current pump duty is 100% (at S330).

If the current pump duty is 100%, the valve opening degree θ is regulated while preventing it from coinciding with the minimum resistance opening degree θx (at S340). Contrarily, if the current pump duty is not 100%, the current valve opening degree θ and pump duty are maintained (at S350).

If it is determined at S320 that the pump entrance water temperature Tp is out of a predetermined range defined by the first target water temperature Tmap, then it is determined whether or not the pump entrance water temperature Tp is higher than the upper limit of the first target water temperature Tmap (at S360). If the answer is affirmative, the current pump duty is maintained and the valve opening degree θ is increased by a predetermined value (at S370).

Then, it is determined whether or not the valve opening degree θ increased by the predetermined value is 100% (at S380). If the answer is affirmative, the pump duty is increased by a predetermined amount (at S390). On the other hand, it the answer is negative, the routine returns to S300.

It is determined whether or not the pump duty increased at S390 is 100% (at S400). If the answer is affirmative, the valve opening degree θ is regulated while preventing it from coinciding with the minimum resistance opening degree θx (at S410). On the other hand, if the answer is negative, the routine returns to S300.

If it is determined at S360 that the pump entrance water temperature Tp is lower than the upper limit of the first target water temperature Tmap, the pump duty is decreased to reduce an amount of circulating coolant, so that the radiator flow rate Vr is decreased, while maintaining the current valve opening θ (at S420). Then, it is determined whether or not the decreased pump duty coincides with the minimum value within a duty control range (in this embodiment, 10%) (at S430).

If the decreased pump duty is larger than the minimum value within the duty control range, the routine returns to S300. On the other hand, if the decreased pump duty is equal to the minimum value within the duty control range, the valve opening degree is reduced (at S440), and then the routine returns to S300.

(Other Embodiments)

While the pump 500 is duty-controlled in the preceding embodiments, the present invention should not be limited thereto but may include other control systems.

In this regard, while a DC brushless motor is adopted for driving the pump 500 in the preceding embodiments, the present invention should not be limited thereto but may include other types of motors.

Also, it should be noted that, although the present invention has been described above with reference to the specific embodiments, many other changes and modifications could be made by a person with ordinary skill in the art without departing from a spirit and/or a scope of claim of the present invention.

What is claimed is:

1. A cooling device for a liquid-cooled type internal combustion engine, comprising:

a radiator (200) for cooling coolant flowing out of the liquid-cooled type internal combustion engine (100) and returning the cooled coolant to the liquid-cooled type internal combustion engine (100);

a bypass circuit (300) for bypassing the radiator (200) and returning the coolant to the liquid cooled-type internal combustion engine (100);

a motor-driven flow rate control valve (400) for regulating a bypass flow rate of coolant flowing through the bypass circuit (300) and a radiator flow rate of coolant flowing through the radiator (200);

a motor-driven pump (500) for circulating the coolant through the liquid-cooled type internal combustion engine (100) and the radiator (200); the pump being driven independently from the liquid-cooled type internal combustion engine (100); and means (600) for determining that a temperature of the coolant should be lowered or raised and for electrically regulating the motor-driven flow rate control valve (400) and the motor-driven pump (500) to change the temperature of the determining means comprising:

first control means for increasing the radiator flow rate of coolant flowing through the radiator (200) when it is determined that the temperature of the coolant should be lowered by firstly increasing a valve opening degree of the motor-driven flow rate control valve (400) and maintaining voltage being applied to the motor-driven pump, said first control means secondly increasing the voltage being applied to the motor-driven pump (500) after the valve opening degree reaches 100%; and second control means for decreasing the radiator flow rate of coolant flowing through the radiator (200) when it is determined that the temperature of the coolant should be raised by firstly lowering the voltage being applied to the motor-driven pump (500) and maintaining the opening degree of the motor-driven flow rate control valve, said second control means secondly decreasing the valve opening degree of the motor-driven flow rate control valve (400) after the voltage being applied to the motor-driven pump reaches a minimum value.

2. A cooling device for a liquid-cooled type internal combustion engine, as defined by claim 1, further comprising temperature detecting means for detecting the temperature of said coolant; wherein:

said determining means (600) comprises means for determining a first target water temperature and means for determining a predetermined temperature range;

said first control means lowers the water temperature of the coolant when the water temperature detected by said temperature detecting means is higher than said predetermined temperature range; and said second control means raises the water temperature of the coolant when the water temperature detected by said temperature detecting means is lower than said predetermined temperature range.

3. A cooling device for a liquid-cooled type internal combustion engine, as defined by claim 2, wherein:

said determining means (600) further comprises third control means for electrically regulating said motor-driven flow rate control valve (400) and said motor-driven pump (500), said third control means determining a second target water temperature when the water temperature detected by said temperature detecting means is within said predetermined range, said third control means maintaining the valve opening degree of said motor-driven flow rate control valve (400) when the water temperature detected by said temperature detecting means is equal to the second target water temperature, said third control means determining the valve opening degree of said motor-driven flow rate control valve (400) from a predetermined map to equalize the water temperature detected by said temperature detecting means to said second target water temperature and to substantially minimize the voltage applied to said motor-driven pump (500) when the water temperature detected by said temperature detecting means differs from said second target water temperature and the valve opening degree of said motor-driven flow rate control valve (400) is less than 100%.

4. A cooling device for a liquid-cooled type internal combustion engine, as defined by claim 2, wherein:

said determining means further comprises third control means for electrically regulating said motor-driven flow rate control valve (400) and said motor-driven pump (500), said third control means determining whether or not the water temperature detected by said temperature detecting means is in said predetermined temperature range when the voltage being applied to said motor-driven pump (500) and the valve opening degree of said motor-driven flow rate control valve (400) are controlled by a predetermined map, said third control means determining whether or not the voltage being applied to said motor-driven pump (500) reaches a maximum value when the water temperature detected by said temperature detecting means is in said predetermined temperature range and controlling the valve opening degree of said motor-driven flow rate control valve (400) so that the valve opening degree does not reach a minimum resistance opening degree when the voltage being applied to said motor-driven pump (500) is substantially the maximum value, said third control means maintaining the valve opening degree and the voltage being applied to said motor-driven pump (500) when the voltage being applied to said motor-driven pump does not reach the maximum value.

* * * * *